United States Patent [19]

Kanai et al.

[11] 4,353,790

[45] Oct. 12, 1982

[54] INSOLUBLE ANODE FOR GENERATING OXYGEN AND PROCESS FOR PRODUCING THE SAME

[75] Inventors: Hideo Kanai; Akihiro Shinagawa, both of Maebashi; Takahiko Yamazaki, Shibukawa; Reiichi Itai, Maebashi, all of Japan

[73] Assignee: The Japan Carlit Co., Ltd., Tokyo, Japan

[21] Appl. No.: 221,290

[22] Filed: Dec. 30, 1980

[30] Foreign Application Priority Data

Feb. 20, 1980 [JP] Japan ..... 55-19904

[51] Int. Cl.[3] ..... C25B 11/08; C25B 11/10; B05D 5/12

[52] U.S. Cl. ..... 204/290 F; 204/291; 204/292; 427/123; 427/125; 427/126.3; 427/126.5

[58] Field of Search ..... 204/290 F, 291, 292; 427/123, 125, 126.3, 126.5

[56] References Cited

U.S. PATENT DOCUMENTS

| | | | |
|---|---|---|---|
| 3,632,498 | 1/1972 | Beer | 204/290 F |
| 3,864,163 | 2/1975 | Beer | 148/6.11 |
| 3,926,751 | 12/1975 | De Nora et al. | 204/105 R |
| 4,157,943 | 6/1979 | Scarpellino et al. | 204/37 R |
| 4,257,856 | 3/1981 | Beni et al. | 204/129 |
| 4,272,354 | 6/1981 | De Nora et al. | 204/290 R |
| 4,285,799 | 8/1981 | De Nora et al. | 204/290 F |

FOREIGN PATENT DOCUMENTS

| | | | |
|---|---|---|---|
| 4387 | 10/1979 | European Pat. Off. | 204/290 F |

*Primary Examiner*—F. Edmundson

*Attorney, Agent, or Firm*—Frishauf, Holtz, Goodman & Woodward

[57] ABSTRACT

An insoluble anode for generating oxygen which comprises a substrate made of titanium or an alloy thereof, a first coating on said substrate which is made of metallic bismuth or bismuth oxides, and a second coating on said first coating which is made of metallic iridium and iridium dioxide, has greatly improved durability and permits use for a long period of time.

8 Claims, 1 Drawing Figure

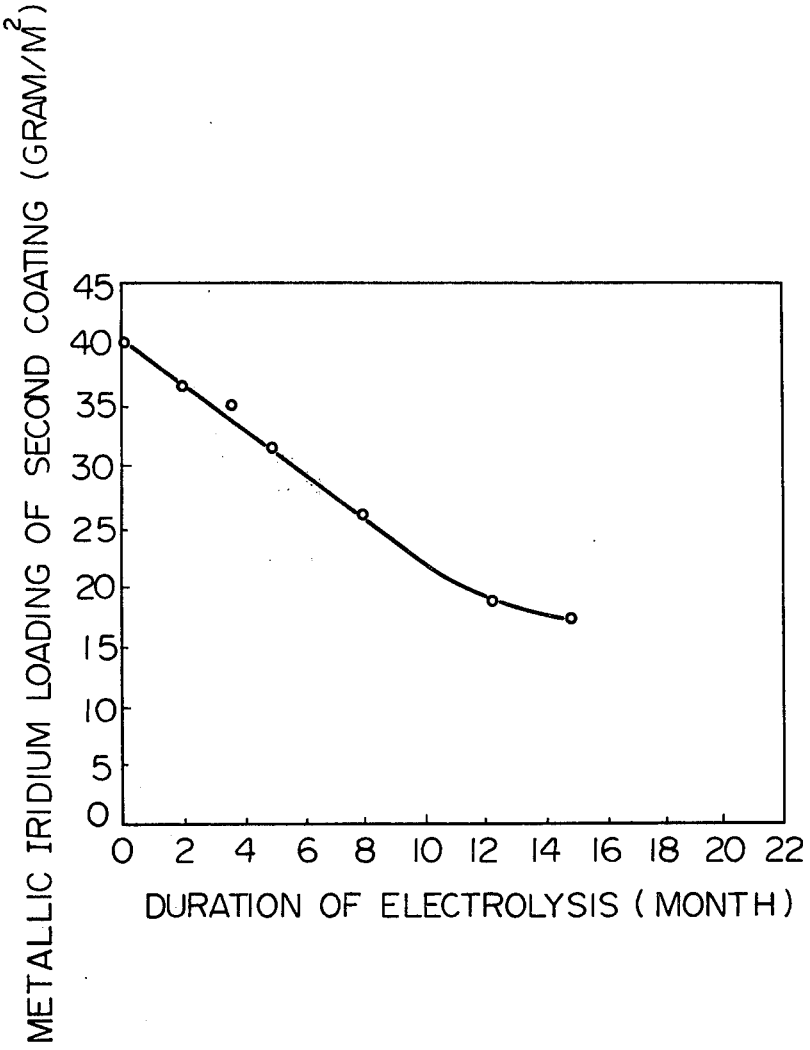
METALLIC IRIDIUM LOADING OF SECOND COATING (GRAM/M²)
45
40
35
30
25
20
15
10
5
0
0 2 4 6 8 10 12 14 16 18 20 22
DURATION OF ELECTROLYSIS (MONTH)

INSOLUBLE ANODE FOR GENERATING OXYGEN AND PROCESS FOR PRODUCING THE SAME

FIELD OF THE INVENTION

This invention relates to an insoluble anode for generating oxygen that is suitable for use in electrolytic winning, electrodeposition and electrolysis in an oxygen-generating environment such as electrolysis of sulfates. The invention also relates to a process for producing such anode.

DESCRIPTION OF PRIOR ART

In the electrolytic industry, there are employed a number of electrolytic techniques: in some of them, chlorine is generated by an anodic reaction, while in others, oxygen is evolved. The fields of the later category include electrolytic winning of metals such as manganese, copper and cobalt, electrodeposition of zinc, tin, copper or their alloys, electrolysis of water, and electrolysis as a step in waste water treatment. An improvement in the insoluble anode for generating oxygen would have great significance and hence has been long sought for in the electrolytic industry.

Lead anodes are the most commonly used in for generating oxygen, but they dissolve gradually and can be used for only 3 to 6 months. In addition, waste liquor containing unpreferable toxic lead is produced. A platinum-coated titanium anode proves fairly durable in a chlorine-generating environment but in an oxygen-generating environment, the anode is subject to much consumption is hardly practicable. Anodes made of an oxide such as magnetite or ferrite do not have adequate durability nor mechanical strength. An anode coated with a solid solution of ruthenium dioxide and titanium dioxide (see U.S. Pat. No. 3,632,498) or anode coated with an alloy of a metal of the platinum group that has ushered in a remarkable technical innovation in brine electrolysis does not have adequate durability in an oxygen-generating environment. Another anode proposed for generating oxygen comprises a substrate having an intermediate layer composed of a platinum-/iridium alloy or an oxide of a metal of the platinum group which is further coated with a solid solution of non-valve metal oxide and a valve metal (see U.S. Pat. No. 3,775,284). Such an anode has achieved some but by no means satisfactory improvement in durability, and the use of the expensive intermediate layer is not economical. Therefore, none of the conventional anodes is ideal for use in electrolysis that involves generation of oxygen.

Titanium or titanium alloy performs equally well as a substrate for the anode for generating chlorine, but they are not very effective as a substrate for the anode for generating oxygen, and the recent trend is to use more costly zirconium as a material for the substrate.

SUMMARY OF THE INVENTION

It is an object of the invention, therefore, to provide an insoluble anode that withstands extended use in an oxygen-generating environment.

It is another object of this invention to provide an insoluble anode for generating oxygen using less expensive titanium or titanium alloy substrate rather than expensive zirconium substrate.

It is still another object of this invention to provide a process for producing an insoluble anode for generating oxygen which has greatly improved durability and which permits use for a long period of time.

Other objects and advantages of the present invention may become apparent to those skilled in the art from the following description and disclosure.

BRIEF DESCRIPTION OF THE DRAWING

FIGURE represents the relation between the duration of electrolysis and the iridium loading of the second coating.

DESCRIPTION OF THE PREFERRED EMBODIMENTS

For the purpose of producing an insoluble anode that withstands extended use in an oxygen-generating environment such as in electrolysis of an acidic sulfate solution, we have made extensive studies on the durability of anode materials, the combination of coating materials, the lamination thereof and the operating conditions for producing the anode. As a result, we have found that an anode for generating oxygen that has greatly improved durability and that permits use for a very long period of time can be produced by forming a first coating of metallic bismuth or bismuth oxides on a substrate made of titanium or its alloy and by forming a second coating made of iridium dioxide and metallic iridium as an anode active material.

Therefore, this invention relates to an insoluble anode for generating oxygen which has on a substrate made of titanium or its alloy a first coating made of metallic bismuth or bismuth oxides and a second coating made of metallic iridium and iridium dioxide formed by heating a layer of an iridium halide solution formed on said first coating by brushing to it or immersing it in said solution, or otherwise applying to it. The invention also relates to a process for producing such anode.

The substrate used in this invention is made of titanium or a titanium alloy such as titanium-palladium of commercial grades in sheets, wires, screens, bars or any other shapes desired may be used.

The first coating of this invention is formed between the substrate made of titanium or titanium alloy and the second coating layer. The first coating protects the surface of the substrate and provides improved contact between the substrate and the second coating. Metallic bismuth or bismuth oxides of which the first coating of this invention is made proves very durable in an oxygen-generating environment and provides a strong protection for the titanium surface. This enables the use of a less expensive titanium or titanium alloy substrate even in an acidic sulfate solution. Bismuth is known to easily form an alloy with another metal. Probably, bismuth forms an alloy with titanium of which the substrate is made and iridium in the second coating to provide greatly improved contact between the second coating and the substrate to thereby extend the life of the anode greatly.

The anode of this invention for generating oxygen uses an active material that is made of metallic iridium and iridium dioxide of which the second coating of this invention is made. As already mentioned, other anode materials are less durable and are not desirable. Iridium dioxide in the second coating has some durability per se but a layer made only of iridium dioxide is apt to separate from the first layer, and it is not until iridium dioxide is used in combination with metallic iridium that a layer that withstands extended use is provided. As a result of the determination of iridium dissolved in electrolyte, the analysis of the composition of the anode surface and the observation of the same surface were performed. We have concluded that a layer made of iridium dioxide loses its durability not because it is passivated but because it separates from the first coating in lumps due to poor contact with each other. To provide intimate contact with the first coating, the second coating of this invention contains metallic iridium, and because of the presence of metallic iridium, the second coating does not separate from the first coating in lumps (i.e. a very intimate contact is formed between the first and second coatings) thus enabling extended use of the resulting anode. The reason why the second coating containing metallic iridium in addition to iridium dioxide provides intimate contact with the first coating is yet to be elucidated, but most probably, metallic iridium forms an alloy with bismuth in the first coating to provide more intimate contact. But a coating made only of metallic iridium allows a great amount of iridium to dissolve in the electrolyte and hence is not suitable for purpose of this invention. The second coating preferably contains 5 to 50 mol%, more preferably 5 to 30 mol% of metallic iridium. Metallic iridium contained in an amount more than 50 mol% only results in increased dissolution of the anode, whereas metallic iridium contained in an amount less than 5 mol% does not provide a durable second coating having good contact with the first coating.

The anode of this invention is produced by the following procedure. A degreased titanium or titanium alloy substrate is surface-treated with hydrofluoric acid or oxalic acid prior to the formation of the first coating made of metallic bismuth or bismuth oxides. A coating of metallic bismuth can be formed by performing electro-deposition in an aqueous solution of a soluble bismuth salt such as bismuth chloride or a mixture of soluble bismuth salts for a period of 1 to 5 minutes or by heating in a reducing flame a substrate to which the bismuth solution has been applied. A coating of bismuth oxide can be formed by electrodeposition of an alkali solution of a bismuth salt or by heating in an electric oven (400°-500° C.×0.5 -5 hr) a substrate to which a bismuth salt solution has been applied. Thus the substrate is coated with the first coating made of metallic bismuth or bismuth oxide. For the specific procedure of the formation of the first coating, see, for example, M. Ya Popereka; Zh, Prikl, Khim, 38, (8) 1783-9 (1965). The first coating serves the purpose of this invention if it has a thickness of about 0.1-5 microns.

The second coating is made of iridium halide selected from the group consisting of iridium monochloride, iridium trichloride, iridium tetrachloride, iridium tetrabromide and iridium triiodide, and iridium tetrachloride is preferred an accout of its high solubility in organic solvent. The following description assumes the use of iridium tetrachloride as the material for the second coating, but it should be understood that the description also applied to the other iridium halides.

Basically, the second coating is formed by applying an iridium tetrachloride solution to the first coating on the substrate and then heating the unit. Any application and heating method can be used of which one example is described below: a complete solution of 1 part by weight of iridium tetrachloride in 4.7 parts by weight of isopropyl alcohol is mixed with 2 parts by weight of a reducing agent such as anise oil to prepare a coating solution. The solution is applied to the first coating by brushing, painting, roll coating, spraying or immersing. After drying, the unit is heated in an electric oven at 400°-500° C. for 10 to 30 minutes to form a dense layer of metallic iridium on the surface. The cycle of application, drying and heating is repeated until the desired thickness is obtained. The unit is then baked in the electric oven at 500°-600° C. for 1 to 5 hours to achieve the oxidation of metallic iridium and to ensure the alloying thereof with bismuth. The baking is continued until the second coating has the desired fraction of metalic iridium. The preferable range of iridium loading is between 10 and 100 g/m$^2$. According to another baking method, the substrate on which a layer of the coating solution containing an iridium halide has been formed by one of the same application or immersion procedures described above is set in an oven with controlled atmosphere where it is heated at 500° to 600° C. in a stream of hydrogen and water vapor. In this alternative method, the fraction of metallic iridium is controlled by adjusting the hydrogen concentration in the oven atmosphere.

The insoluble anode thus produced by this invention is used with advantage in various environments of electrolysis that generate oxygen such as electrolytic winning of manganese, cobalt or copper, electrodeposition of zinc, tin or copper, electrolysis of water, and electrolysis as a step of waste water treatment. The anode can be used continuously for a period of one year or longer in electrolysis that is accompanied by evolution of oxygen. It also permits electrolytic operation at a current density as high as 100 A/dm$^2$ and hence will prove very valuable as an industrial tool.

This invention is now described in greater detail by reference to the following examples which are given here for illustrative purposes only and are by no means intended to limit the scope of the invention.

EXAMPLE 1-A

A titanium sheet measuring 40 mm×200 mm×2 mm was washed with an organic solvent and then degreased by immersion in 10% boiling aqueous sodium hydroxide for 30 minutes. The surface oxide coating of the titanium sheet was removed by immersion in 5% hydrofluoric acid for 1 minute at ordinary temperature, followed by washing with water. A first coating made of metallic bismuth was plated on the titanium substrate under the following conditions:

| Plating conditions | |
|---|---|
| Bismuth trichloride ($BiCl_3$) | 48 g/l |
| Hydrochloric acid (HCl) | 117 g/l |
| Temperature | 20-40° C. |
| Current density | 1 A/dm$^2$ |
| Duration of plating | 4 min |

A coating solution was prepared by mixing iridium tetrachloride first with isopropyl alcohol, then with anise oil in the amounts indicated below. The solution was applied to the first coating with a brush, then dried.

| Composition of coating solution | |
|---|---|
| 1. Iridium tetrachloride ($IrCl_4.H_2O$) | 1.5 g |
| 2. Isopropyl alcohol | 7.1 g |
| 3. Anise oil | 3.0 g |

The unit was transferred into an electric oven where it was heated in air at 450° C. for 15 minutes. The cycle of application, drying and heating was repeated five more times. The unit was then baked in the oven at 550° C. for 2 hours until a second coating of metallic iridium and iridium dioxide that contained about 20 mol% of metallic iridium (as determined by X-ray diffractiometry) was formed. Measurement of the thickness of the second coating with an RI fluorescent X-ray spectrometer (source: plutonium 238, prove area: 1 $cm^2$, measuring time: 40 sec) gave the following results: 95,800 counts, and iridium loading of 40 $g/m^2$. The second coating comprised a uniform and dense layer.

EXAMPLE 1-B

The durability of the insoluble anode produced in Example 1-A was checked by conducting electrodeposition of tin under the following conditions.

| Electrolytic conditions | |
|---|---|
| Tin sulfate ($SnSO_4$) | 50 g/l |
| Sulfuric acid ($H_2SO_4$) | 60 g/l |
| Phenolsulfonic acid | 48 g/l |
| Metacresylic acid | 2.4 g/l |
| Anode current density | 100 $A/dm^2$ |
| Current efficiency | ca. 100% |
| Cell temperature | 40° C. |
| Cathode | stainless steel |

Little change was observed in the surface of the anode at the end of the electrodeposition that lasted for one year and three months. No abnormal increase in the cell voltage occurred. On several occasions in the test period, the thickness of the second coating was measured by an RI fluorescent X-ray spectrometry, and the results are shown in Table 1 and FIGURE represents that the life of the anode is one year or longer.

TABLE 1

| time when measurement was taken | counts | iridium loading ($g/m^2$) |
|---|---|---|
| initial | 95,800 | 40 |
| 2 months | 89,300 | 36.7 |
| 3 months and 18 days | 86,000 | 35 |
| 5 months | 79,000 | 31.5 |
| 8 months | 68,900 | 26.4 |
| 12 months and 6 days | 51,000 | 18.0 |
| 15 months | 49,200 | 17.0 |

During the life test, the electrolyte was replaced periodically and the stainless steel cathod was replaced as required.

EXAMPLE 1-C AND COMPARATIVE EXAMPLE 1

To know the durability of the insoluble anode of this invention, it was used in electrolysis in aqueous sodium sulfate under the conditions specified below. The time when the cell voltage increased suddenly was assumed to be the life of that anode. Six other anodes were subjected to the same life test, and the results are shown in Table 2 below.

| Electrolytic conditions | |
|---|---|
| $Na_2SO_4.10H_2O$ | 250 g/l |
| pH | 1 (due to $H_2SO_4$) |

-continued

| Electrolytic conditions | |
|---|---|
| Anode current density | 50 $A/dm^2$ |
| Current efficiency | ca. 100% |
| cell temperature | 40° C. |
| Cathode | stainless steel |

TABLE 2

| Anode | anode life (days) | dead anode surface | others |
|---|---|---|---|
| anode of Ex. 1-A | >400 | little change | |
| commercial Pb alloy anode | 60 | through holes formed locally | precipitate formed |
| commercial Pt-plated Ti anode | 18 | titanium surface exposed | |
| $RuO_2.TiO_2/Ti$ anode (Ti substrate with $RuO_2/TiO_2$ coating in 4:6 molar ratio) | 15 | titanium surface exposed | |
| $RuO_2.PdO.TiO_2/Ti$ anode (Ti substrate with $RuO_2/PdO/TiO_2$ coating in 1:4:20 molar ratio) | 4 | titanium surface exposed | |
| commercial Pt.Ir/Ti anode | 40 | titanium surface exposed | |
| commercial magnetite anode | <10 | dissolved out locally | amount of dissolution 60 mm/y |

EXAMPLE 1-D AND COMPARATIVE EXAMPLE 2

To know the intimacy of the contact between the titanium substrate and the second coating in the insoluble anode of this invention, a tape test was conducted with the following four anodes: (1) an anode as prepared in Example 1-A, (2) an anode having a second coating made of only iridium dioxide, (3) an anode having a second coating made of only metallic iridium, and (4) an anode comprising a titanium substrate directly coated with iridium dioxide. The iridium loading of each anode was 40 $g/m^2$. The four anodes were used in electrolysis under the same conditions as specified for Comparative Example 1 except that the electrolyte was flown between the electrodes at a rate of about 2 m/sec. The results of the observation of each anode surface are described in Table 3 below.

TABLE 3

| Anode | Tape test | Anode surface observed 3 months later |
|---|---|---|
| anode of Ex. 1-A | no separation | no change |
| anode with 2nd coating made of only iridium dioxide (iridium level:40 $g/m^2$) | some separation | some trace of coming off of lumps |
| anode comprising Ti substrate directly coated with iridium dioxide (iridium level:40 $g/m^2$) | separated | some trace of coming off of lumps |
| anode with 2nd coating made of only metallic iridium (iridium level:40 $g/m^2$) | no separation | dissolved out, cell voltage increased |

EXAMPLE 2

A degreased titanium-palladium plate was surface-treated with hot aqueous oxalic acid. To the substrate, 10% aqueous bismuth nitrate was applied and dried.

The substrate was then heated in an electric oven at 450° C. for 60 minutes to form a first coating made of bismuth oxide. A coating solution of the same composition as that used in Example 1-A was applied to the first coating and dried. The unit was placed in an oven where it was heated at 520° C. for 2 hours in a mixture of hydrogen (20 vol%) and water vapor (80 vol%). A dark gray, dense uniform second coating was formed on the first coating. X-ray analysis of the resulting anode showed that the second coating was surely composed of metallic iridium and iridium dioxide. The metallic iridium loading of the second coating was 10 mol%. Analysis with RI fluorescent X-ray showed that the thickness of the second coating was such that it contained 55 g of iridium per square meter (126,000 counts). The anode performed well in electrolysis of an alkaline waste water under the following conditions.

Electrolytic Conditions

Anode . . . the same as what was prepared in Example 2
Cathode . . . stainless steel
Electrolyte . . . zinc cyanide plating solution (tot. cyan conc. 30,000–34,000 ppm, NaOH 90 g/l
Current density . . . 7 A/dm$^2$
Cell temperature . . . 50°–60° C.
Electrolytic time . . . 20–25 hr (batchwise)

Results

Total cyanide conc. . . . less than 1,100 ppm
Current efficiency . . . more than 85%
Service period . . . 6 months in batch process
Anode surface . . . no change

What is claimed is:

1. An insoluble anode for generating oxygen which comprises a substrate made of titanium or an alloy thereof, a first coating on said substrate which is made of metallic bismuth or bismuth oxides and a second coating on said first coating layer which is made of metallic iridium and iridium dioxide, said second coating containing 5 to 50 mol% of metallic iridium.

2. An insoluble anode according to claim 1 wherein said second coating has an iridium loading of 10 to 100 g/m$^2$.

3. A process for producing an insoluble anode for generating oxygen which comprises forming a first coating made of metallic bismuth or bismuth oxides on a substrate made of titanium or its alloy, applying a solution of iridium halide in water or an organic solvent, drying the substrate and heating the substrate at 400° to 500° C. for a period of 10 to 30 minutes, repeating the cycle of iridium halide application, drying and heating as many times as required until a second coating of the desired thickness is obtained, followed by heating the unit at 500° to 600° C. for a period of 1 to 5 hours.

4. A process according to claim 3 wherein said solution of iridium halide is applied by means of one way of brushing, painting, roll coating, spraying thereof and immersing therein.

5. A process according to claim 3 or 4 wherein the iridium halide is selected from the group consisting of iridium monochloride, iridium trichloride, iridium tetrachloride, iridium tetrabromide and iridium triiodide.

6. A process according to claim 3 or 4 wherein the solution of iridium halide comprises 1 part by weight of iridium halide, 4.7 parts by weight of isopropyl alcohol and 2 parts by weight of anise oil.

7. A process according to claim 5 wherein the solution of iridium halide comprises 1 part by weight of iridium halide, 4.7 parts by weight of isopropyl alcohol and 2 parts by weight of anise oil.

8. In an electrolytic process wherein an insoluble anode is inserted into an aqueous electrolyte and wherein oxygen is generated at said insoluble anode, the improvement comprising using the anode of claim 1 or claim 2 as said insoluble anode.

* * * * *

UNITED STATES PATENT AND TRADEMARK OFFICE

CERTIFICATE OF CORRECTION

PATENT NO. : 4,353,790

DATED : October 12, 1982

INVENTOR(S) : Hideo KANAI et al

It is certified that error appears in the above–identified patent and that said Letters Patent are hereby corrected as shown below:

Column 7, line 23: rewrite "cyan" as --cyanide--.

Signed and Sealed this

Second Day of August 1983

[SEAL]

*Attest:*

GERALD J. MOSSINGHOFF

*Attesting Officer*

*Commissioner of Patents and Trademarks*